US005715625A

United States Patent [19]

West, III

[11] Patent Number: 5,715,625

[45] Date of Patent: Feb. 10, 1998

[54] PORTABLE SHOOTER'S BENCH

[76] Inventor: David T. West, III, 1925 Maplewood Dr., Hagerstown, Md. 21740

[21] Appl. No.: 770,817

[22] Filed: Dec. 20, 1996

[51] Int. Cl.[6] ..... F41A 23/14

[52] U.S. Cl. ..... 42/94

[58] Field of Search ..... 42/94; 89/37.01; 248/176.1, 166, 164, 118; 297/217.1, 195.11, 183.5

[56] References Cited

U.S. PATENT DOCUMENTS

| | | | |
|---|---|---|---|
| 3,711,984 | 1/1973 | Dryer et al. | 42/94 |
| 4,501,082 | 2/1985 | Phillips et al. | 42/94 |
| 4,506,466 | 3/1985 | Hall | 42/94 |
| 4,535,559 | 8/1985 | Hall | 42/94 |
| 4,565,403 | 1/1986 | Brown | 297/3 |
| 4,886,229 | 12/1989 | Aripze-Gilmore | 248/125 |
| 4,967,497 | 11/1990 | Yakscoe | 42/94 |
| 5,060,410 | 10/1991 | Mueller | 42/94 |
| 5,149,900 | 9/1992 | Buck | 42/94 |
| 5,271,175 | 12/1993 | West, III | 42/94 |
| 5,287,643 | 2/1994 | Arizpe-Gilmore | 42/94 |

FOREIGN PATENT DOCUMENTS 318340 1/1920 Germany .

*Primary Examiner*—Charles T. Jordan
*Assistant Examiner*—Meena Chelliah
*Attorney, Agent, or Firm*—Dowell & Dowell

[57] ABSTRACT

A portable shooter's bench which includes a seat carried by a pivotable leg assembly and from which assembly a firearm support rest is adjustably mounted. In the preferred embodiment, the seat functions as a carrying handle and the bench automatically folds when lifted to carry.

13 Claims, 3 Drawing Sheets

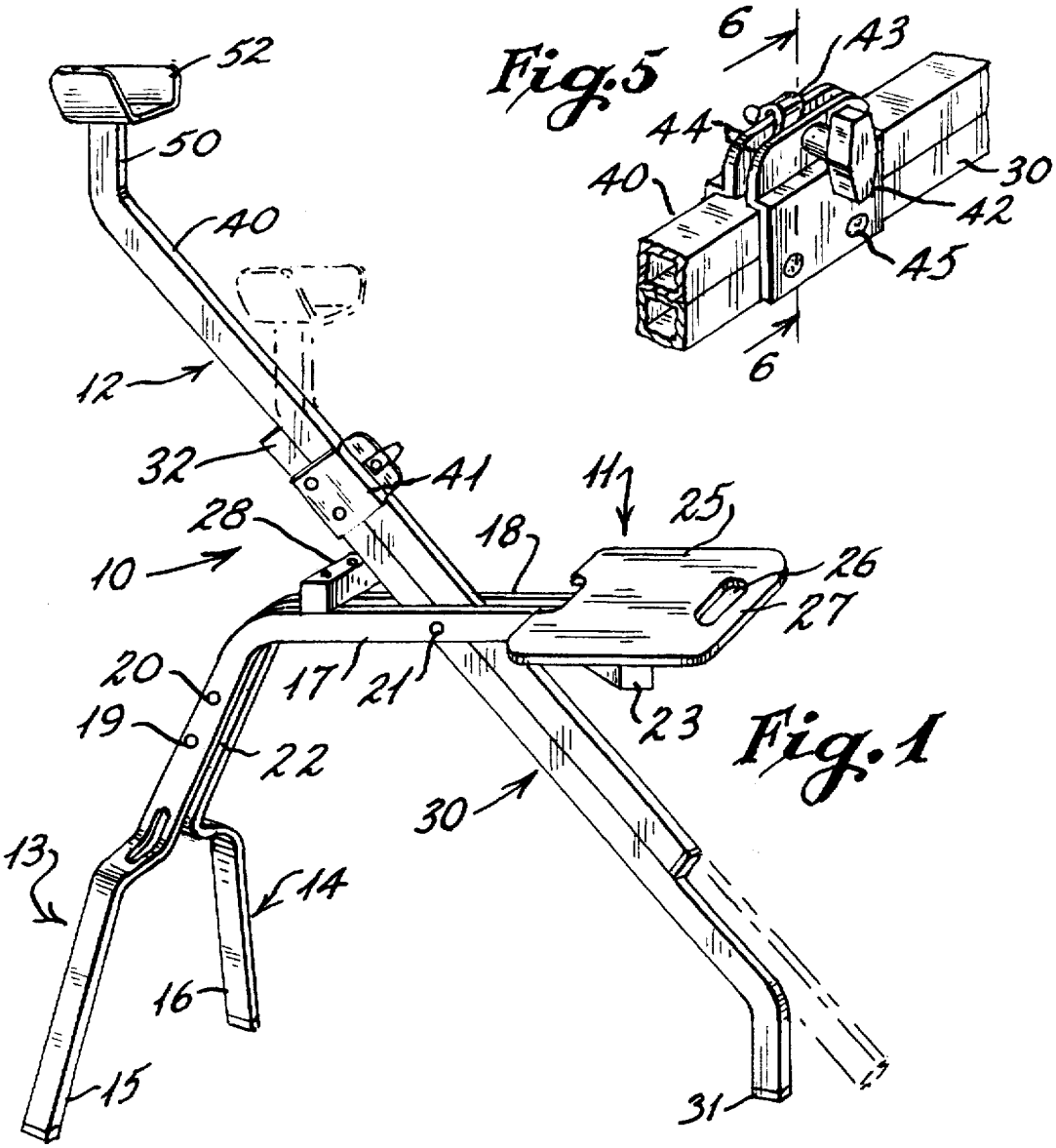
Fig.5
Fig.1
Fig.2
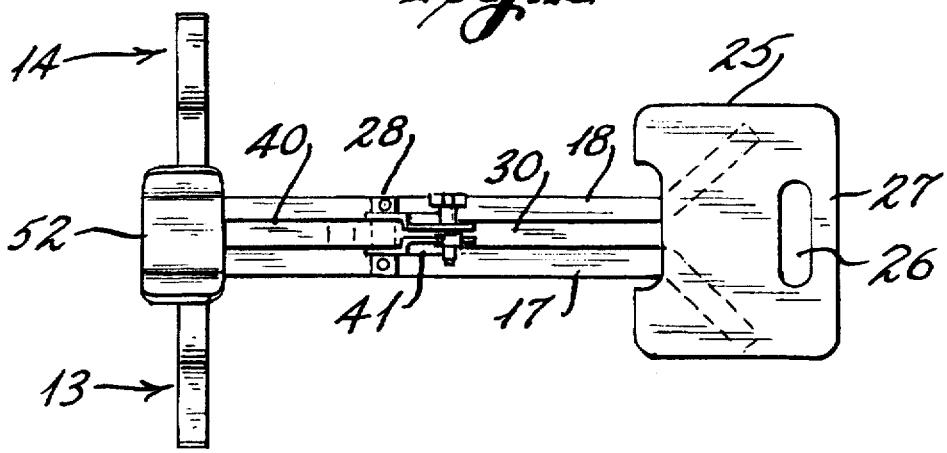

PORTABLE SHOOTER'S BENCH

BACKGROUND OF THE INVENTION

1. Field of the Invention

This invention is generally directed to seating devices which may be utilized by hunters, marksman and other firearm users and more particularly to a lightweight and portable shooting seat and firearm support which may be easily set up for use in target areas or in the field without the use of tools and which is designed to be collapsible for compact storage and carrying.

2. History of the Related Art

Various types of shooter's benches or seats have been designed for use by firearm enthusiasts both for recreational target shooting as well as for use in the field. The purposes of such seats is to provide a convenient support for an individual while simultaneously providing a surface upon which a firearm can be rested for purposes of perfecting aim of the firearm relative to a selected target.

Unfortunately, many prior art shooter's benches are bulky and complex and not suitable for portability in the field. In addition, many prior art shooter's benches which are designed to be portable, in fact, require assembly for use and disassembly in order to be transported. These types of structure are too complex to be convenient for most individuals.

In U.S. Pat. No. 5,287,643 to Arizpe-Gilmore a portable hunting seat is disclosed which is designed to overcome many of the shortcomings of prior art shooting seats which are considered to bulky to be conveniently carried into the field. The patent discloses a seat of flexible canvas-like material which is secured to the central portion of a pair of generally u-shaped leg members which are pivotably secured intermediate their length. A firearm support arm having a u-shaped base is pivotably mounted to one of the u-shaped legs and includes a vertical extension to which a u-shaped firearm support is threadingly received. The seat may be folded by folding the u-shaped legs toward one another and thereafter pivoting the firearm support relative to the legs. The foldable hunting seat provides an advantage over prior art portable shooting seats and benches in that it is lightweight and easily assembled in the field without tools. Unfortunately, the seat does not provide adequate alignment between the seat and the firearm support arm to allow convenient seating and aiming of a weapon being supported within the u-shaped firearm support. In addition, because of the vertical extension of the firearm support, the unit is not easily carried, especially when used in the field.

In view of the foregoing, there is a need to provide a portable hunters or shooters seat and firearm support which is not only lightweight and easily portable but one in which the firearm support portion may be easily adjusted so as to be conveniently aligned for use by individuals without requiring the use of tools and wherein the assembly is easily foldable into a compact configuration for carrying.

Some additional examples of the prior art, include U.S. Pat. No. 4,886,229 to Arizpe-Gilmore, U.S. Pat. No. 4,565,403 to Brown, U.S. Pat. No. 4,501,082 to Phillips et al., U.S. Pat. No. 3,711,984 to Dyer et al., U.S. Pat. No. 5,060,410 to Mueller, U.S. Pat. No. 4,535,559 to Hall, U.S. Pat. No. 4,506,466 to Hall U.S. Pat. No. 5,271,175 to West and German U.S. Pat. No. 318340.

SUMMARY OF THE INVENTION

The present invention is directed to a portable shooter's seat and firearm support which includes a seat which is carried at one end of a pair of generally parallel oriented front legs having lower end portions which are spaced from one another for contact with the ground. The front legs approach one another from the lower portion towards the seat and are retained in spaced relationship so as to permit a third or rear leg to be pivoted therebetween in such a manner that the seat is positioned generally over the rear leg when the seat is in use. The front legs and the seat are rigidly secured to one another in such a manner that the seat is generally aligned along an axis taken between the base portion of the front legs. A stop member is also mounted between the upper portion of the front legs which serves to support the upper portion of the rear leg when the seat is in use.

A firearm support arm is adjustably mounted relative to the rear leg in such a manner that the arm may be slidingly disposed in a retracted position between the upper portions of the fixed front legs. Mounted to the upper portion of the firearm support arm is a weapon support bracket on which a firearm may be stabilized.

In the preferred embodiment, a handle is integrally formed with the seat. The unit is designed to automatically fold when lifted from a use position, such that after the firearm support arm is released to slide to its fully retracted position, elevating the unit by lifting the seat automatically causes the unit to fold to a compact configuration.

In another embodiment of the present invention, a supplemental support is adjustably mounted to the firearm support arm which includes a platform for stabilizing a shooter's upper body.

It is the primary object of the present invention to provide a combination shooter's seat and firearm support which is lightweight and easily portable so that it may be easily and quickly set up in the field without the use of tools and can be conveniently and readily disassembled and folded for carrying by simply raising the seat and lifting the unit from a support surface.

It is yet another object of the present invention to provide an economical and lightweight portable shooter's bench and firearm support wherein the firearm support is generally aligned centrally with the seat and wherein the firearm support is adjustable both horizontally outwardly relative to the seat as well as vertically upwardly relative thereto in such a manner that complete adjustment is possible so as to ensure the most comfort and convenience for an individual shooter.

It is yet a further object of the present invention to provide a portable shooting seat and firearm support wherein the entire unit may be folded into a compact assembly to thereby facilitate use of the unit in the field and to minimize the requirement for storage space when the unit is not in use.

It is also an object of the present invention to provide a portable shooting bench seat and firearm support which may be utilized not only as a shooting seat but as a portable camping seat and which, in some embodiments, may further be modified by including a supplemental support for stabilizing a shooter's upper body to increase shooting accuracy.

BRIEF DESCRIPTION OF THE DRAWINGS

FIG. 1 is a rear perspective view of the portable shooter's bench of the present invention showing the bench erected for use and the adjustable firearm support arm moved from a retracted dotted line position to a fully extended solid line position.

FIG. 2 is a top plan view of the shooter's bench of FIG. 1.

FIG. 5 is an enlarged partial perspective view of the firearm support arm lock of the present invention.

DESCRIPTION OF THE PREFERRED EMBODIMENT

Figure 3:
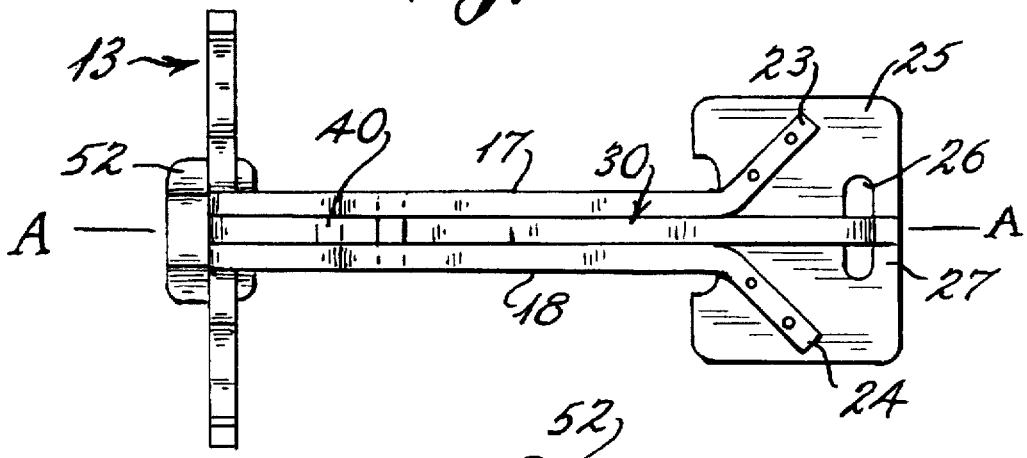
FIG. 3 is a bottom plan view of the shooter's bench of FIG. 1.
Figure 4:
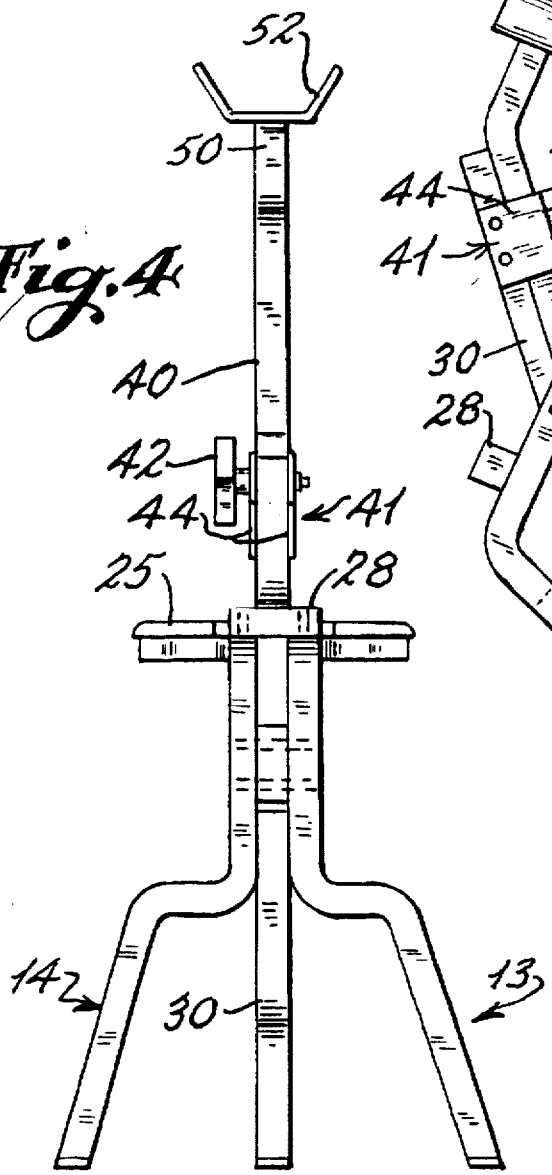
FIG. 4 is a front elevational view of the shooter's bench of FIG. 1.

With continued reference to the drawing figures, the shooter's bench 10 of the present invention is directed to combination of a portable seat 11 and firearm support mechanism 12. The seat includes a first pair of generally fixed front support legs 13 and 14 having lower portions 15 and 16, respectively which are plugged or capped to provide ground contact portions. Each of the lower ends is flared outwardly with respect to one another to provide a stable support for the seat 11. An intermediate portion of each leg is formed with a bend of approximately 60° so that when the bottom portion of the legs 13 and 14 are inclined at an angle relative to a support surface, the upper portions 17 and 18 thereof are generally horizontal, as shown in FIG. 1. The legs 13 and 14 are fixedly secured to one another by a plurality of pins 19, 20 and 21 and a spacer 22 so that they are spaced from one another. The outermost portions 23 and 24 of each leg 13 and 14 flare outwardly with respect to one another and provide stability for a seat platform 25 which is welded, bolted or otherwise secured thereto. The seat may be formed of metallic material or molded from a suitable strong plastic material. In the preferred embodiment, an opening 26 is provided in the outer portion of the seat to thereby define a handle 27. The legs 13 and 14 are further reinforced by a stop block 28 which is mounted to the horizontal portions 17 and 18 thereof adjacent the bend between the upper and lower portions of the legs. The block may be mounted by appropriate fasteners or welded in the position shown in the drawing figures.

As shown in the drawing figures, the central portion of the seat is generally aligned between the lower portions of 15 and 16 of the legs 13 and 14 for purposes of providing stability for the seat when the bench is in use.

A third or rear leg 30 is pivotably mounted about the pivot pin 21 and includes a lower grounding gauging capped end portion 31. The upper portion 32 of the pivotable leg 30 extends above the horizontal portions 17 and 18 of the fixed legs 13 and 14 and is designed to rest against the support block 28 when the seat is in use, as is shown in FIG. 1. The legs 13, 14 and 30 thereby form a tripod support for the seat platform 25. As shown in the drawings, the seat platform 25 is spaced generally above and slightly inwardly of the end portion 31 of the pivotable leg 30 so that all weight applied to the seat platform 25 is generally inwardly of the outer portion of the leg and between the legs 13, 14, and 30. The seat is also generally aligned centrally with the leg 30 along an axis A-A so that, when in use, an individual sits upon the platform 25 stratling the leg 30.

Figure 7:
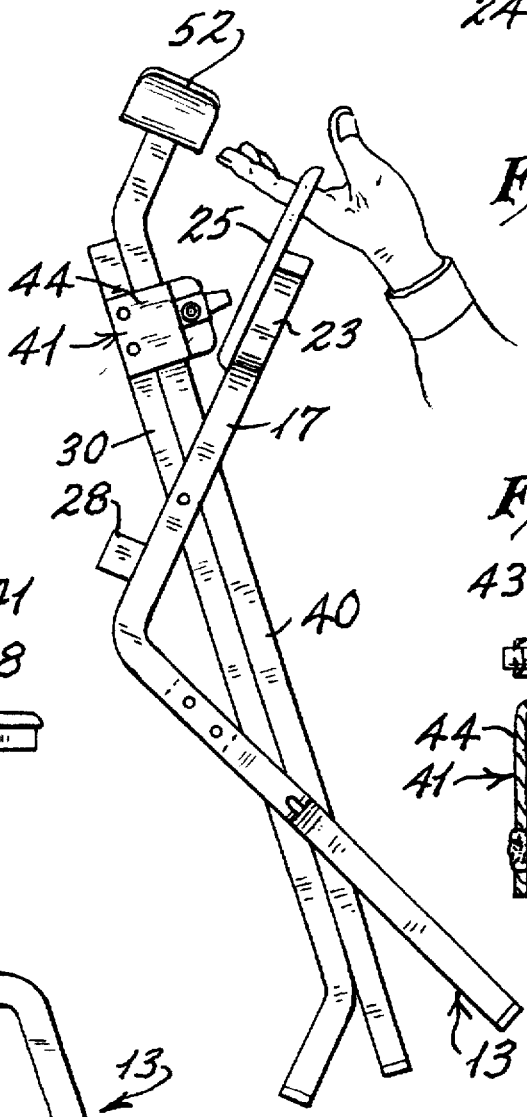
FIG. 7 is an illustrational view of the shooter's bench of FIG. 1 folded to a compact carrying position as the seat is lifted.
Figure 6:
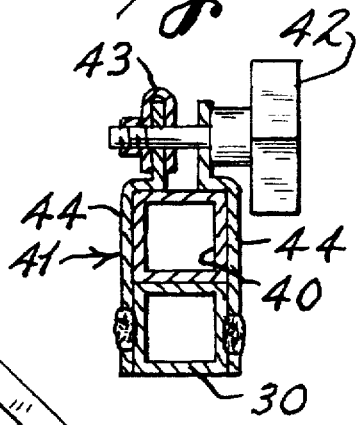
FIG. 6 is a view taken along lines 6—6 of FIG. 5.

The gun rest support 12 includes a support arm 40 which is adjustably connected by a locking bracket 41 in a telescoping fashion relative to the pivotable leg 30. In a carrying position, as shown in FIG. 7 the support arm 40 is lowered so as to be generally coextensive with the leg 30 and locked in position by a threaded knob 42 which is threaded to a clip 43 mounted to a two part clamp 44 which is fixed at 45 to the leg 30. The adjusting lever is large enough to allow an individual to apply sufficient clamping force to lock the support arm 40 in any selected extended position relative to the leg 30. The upper portion 50 of the firearm support is bent generally vertically and supports a generally u-shaped firearm support member 52. In some embodiments, the member 52 may be replaced by other types of firearm supports, such as a shelf or flat support surface.

From a review of the drawings, it is noted that the height and the horizontal spacing of the support member 52 relative to the seat platform 25 may be varied by loosening the bracket member 41 and extending or retracting the firearm support arm 40 relative to the leg 30. In this way, the height and position of the firearm support may be adjusted to fit an individual shooter.

When it is desired to transport the shooter's bench of the present invention, the clamping bracket 41 is loosen allowing the firearm support 40 to slide into the lower dotted position, as shown in FIG. 1 so as to be coextensive with the leg 30. Thereafter, the bracket is clamped to secure the firearm support arm relative to the leg. After which, by simply grasping the handle portion 27 of the seat platform 25 and elevating the seat, the unit folds into a clasped position, as shown in FIG. 7. It should be noted that in the folded configuration, the unit is very compact and may be easily transported. Although not shown in the drawing figures, an appropriate sling may be attached at various portions of the unit for facilitating backpacking or carrying of the shooter's bench.

Figure 8:
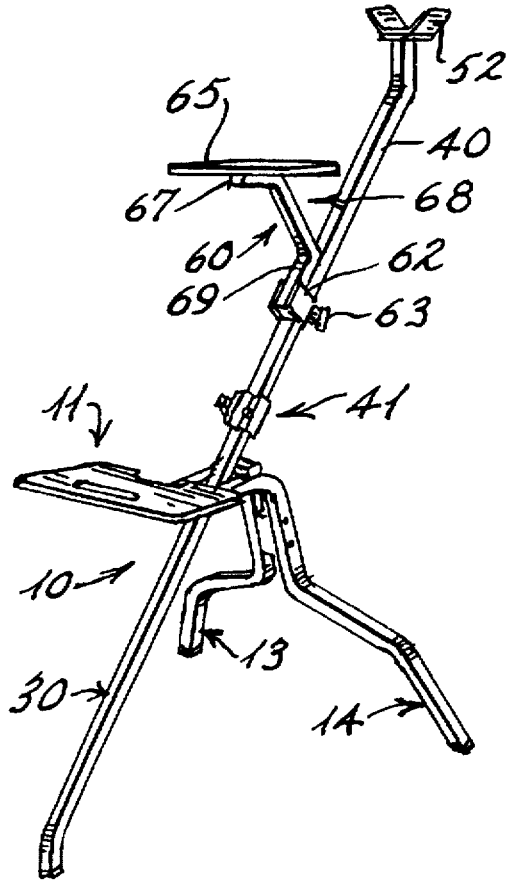
FIG. 8 is a front perspective view of another embodiment of shooter's bench in accordance with the teachings of the present invention, showing a supplemental support member.
Figure 9:
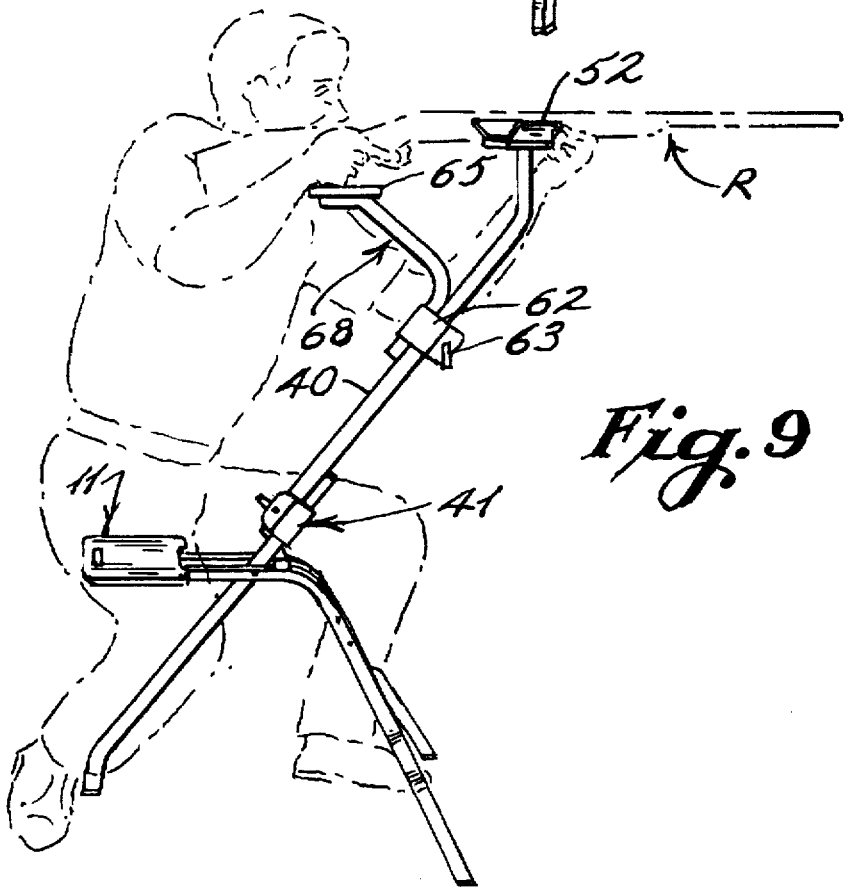
FIG. 9 is a view taken from the right side of the shooter's bench of FIG. 8 showing the shooter's bench in use with a shooter and rifle being illustrated in dotted line.

With particular reference to FIGS. 8 and 9, another embodiment of the present invention is disclosed. In this embodiment, the shooter's bench 10 includes a supplemental support 60 which is adjustably mounted along the firearm support arm 40 by way of a clamping bracket 62. The clamping bracket 62 is similar to locking bracket 41 and includes a pair of clamping members which are engaged by an adjustment knob 63. The bracket clamps against the firearm support arm 40 in a such a manner that by loosening the knob 63, the bracket 62 may be moved along the length of the support arm to obtain a proper position for a platform 65 on which the heel of an individual's wrist is supported, as shown in dotted line in FIG. 9. In the drawing figures, the platform is shown as being generally planar in configuration and, in some instances, the platform may be appropriately contoured or padded. The platform is attached by fasteners (not shown) to a horizontal extension 67 of a tubular brace 68 which extends downwardly towards the firearm support arm 40 and ends in a lower portion 69 which is parallel to the firearm support arm. The bracket 62 engages the lower portion 69 of the brace and clamps the support member of the firearm support arm 40.

In use of the embodiment shown in FIGS. 8 and 9, after the rifle "R"is cradled within the support member or bracket 52, the butt end of the rifle and the shooter's hand are engaged on the platform 65. The platform is designed to extend laterally on opposite sides of the axis of the firearm support arm 40 so that it may be used equally well by a left-handed or right-handed shooter. The support member 60 thereby allows for increased stabilization of the shooter's upper body, thereby increasing firing accuracy. By loosening the adjustment knob 63, the brace 68 may be slidingly moved along the support arm 40 and may also be removed when desired.

In the preferred embodiment, the components including the legs and the firearm support arm are manufactured of a tubular metallic material having a generally rectangular cross section and which is light in weight. In some embodiments, plastics may also be utilized.

The foregoing description of the preferred embodiments of the invention has been presented to illustrate the principles of the invention and not to limit the invention to the particular embodiments illustrated. It is intended that the scope of the invention be defined by all of the embodiments encompassed within the following claims and their equivalents.

I claim:

1. A portable shooter's bench for use in supporting a firearm comprising:

a pair of front legs having lowered portions and angularly related upper portions, means for spacing the upper portions relative to one another, a seat mounted to said upper portions of said front legs, a stop member mounted on said upper portion of said front legs in spaced relationship to said seat, a rear leg pivotably mounted between said stop member and said seat and between and to said upper portions of said front legs, said rear leg having a first portion extending below said upper portions of said front legs and a second portion extending above said upper portions of said front legs, said rear leg being pivotable from a deployed position wherein said lower portion of said rear leg is substantially below said seat and said rear leg engages said stop member to a retracted position wherein said lower portion of said rear leg is pivoted toward said lower portion of said front legs, a firearm support arm adjustably slideably mounted to said rear leg so as to be selectively extendable upwardly and outwardly relative to said upper portion of said rear leg, first securing means for securing said firearm support arm in a selected adjusted position relative to said rear leg, and a firearm support carried by said firearm support arm.

2. The portable shooter's bench of claim 1 including a handle integrally formed with said seat.

3. The portable shooter's bench of claim 2 in which said lower portions of said front legs are flared outwardly relative to one another.

4. The portable shooter's bench of claim 3 in which said firearm support is formed as a generally u-shaped member.

5. The portable shooter's bench of claim 4 in which said upper portions of said front legs include outer ends which are flared outwardly with respect to one another upon which said seat is mounted.

6. The portable shooter's bench of claim 5 in which said first securing means for securing said firearm support arm is a bracket including a pair of clamping plates secured to said upper portion of said rear leg and having outer flange portions, and a knob threadingly mounted to said outer flange portions for selectively clamping said plates to said firearm support arm.

7. The portable shooter's bench of claim 6 including a supplemental support member and second securing means for securing said supplemental support member to said firearm support arm.

8. The portable shooter's bench of claim 7 wherein said supplemental support member includes a platform extending from said firearm support arm toward said seat and being generally parallel thereto, and a brace member extending from said platform to said firearm support arm.

9. The portable shooter's bench of claim 8 in which said second securing means includes an adjustable clamping bracket mounted to said brace member for clampingly engaging said firearm support arm.

10. The portable shooter's bench of claim 2 including a supplemental support member and second securing means for securing said supplemental support member to said firearm support arm.

11. The portable shooter's bench of claim 1 including a supplemental support member and second securing means for securing said supplemental support member to said firearm support arm.

12. The portable shooter's bench of claim 11 wherein said supplemental support member includes a platform extending from said firearm support arm toward said seat and being generally parallel thereto, and a brace member extending from said platform to said firearm support arm.

13. The portable shooter's bench of claim 12 in which said second securing means includes an adjustable clamping bracket mounted to said brace member for clampingly engaging said firearm support arm.

* * * * *